US012667875B2

(12) United States Patent
Bernes et al.

(10) Patent No.: US 12,667,875 B2
(45) Date of Patent: Jun. 30, 2026

(54) METHOD FOR PREHEATING A WORKING ROLL FOR ROLLING

(71) Applicant: CONSTELLIUM ISSOIRE, Issoire (FR)

(72) Inventors: Romain-Fabrice Bernes, Issoire (FR); Daniel Bellot, Izeaux (FR); Vincent Duhoux, Coublevie (FR); Clement Questroy, La Roche Blanche (FR); Jean-François Verdier, Issoire (FR)

(73) Assignee: CONSTELLIUM ISSOIRE, Issoire (FR)

( * ) Notice: Subject to any disclaimer, the term of this patent is extended or adjusted under 35 U.S.C. 154(b) by 368 days.

(21) Appl. No.: 18/574,344

(22) PCT Filed: Jun. 28, 2022

(86) PCT No.: PCT/FR2022/051290
§ 371 (c)(1),
(2) Date: Dec. 27, 2023

(87) PCT Pub. No.: WO2023/275488
PCT Pub. Date: Jan. 5, 2023

(65) Prior Publication Data

US 2024/0286181 A1 Aug. 29, 2024

(30) Foreign Application Priority Data

Jul. 2, 2021 (FR) ..... 2107217

(51) Int. Cl.
*B21B 27/10* (2006.01)
*B21B 37/32* (2006.01)

(52) U.S. Cl.
CPC ..... *B21B 27/106* (2013.01); *B21B 37/32* (2013.01); *B21B 2267/19* (2013.01)

(58) Field of Classification Search
None
See application file for complete search history.

(56) References Cited

U.S. PATENT DOCUMENTS 2,088,241 A * 7/1937 Irvin ..... B21B 27/10 72/202
6,014,881 A * 1/2000 Imanari ..... B21B 37/32 72/201

(Continued)

FOREIGN PATENT DOCUMENTS

DE 19503363 A1 * 9/1995 ..... B21B 37/28
DE 102006001195 A1 7/2007

(Continued)

OTHER PUBLICATIONS

International Search Report (with English translation) and Written Opinion issued in International Application No. PCT/FR2022/051290 (Oct. 10, 2022).

*Primary Examiner* — Jared O Brown
(74) *Attorney, Agent, or Firm* — McBee Moore & Vanik IP, LLC

(57) ABSTRACT

A method for preheating at least one working roll of a rolling mill. The method including determining a target thermal expansion profile of the working roll, determining an effective mean temperature profile of longitudinal segments of the working roll, determining a target mean temperature profile, and activating a plurality of inductors distributed along the working roll in order to reduce a difference between the effective mean temperature and the target mean temperature.

18 Claims, 3 Drawing Sheets

(56) References Cited

U.S. PATENT DOCUMENTS

| | | | | |
|---|---|---|---|---|
| 6,430,461 | B1 * | 8/2002 | Andorfer | B21B 37/00 700/148 |
| 2009/0193645 | A1 * | 8/2009 | Seidel | B21B 1/46 72/200 |
| 2017/0080467 | A1 * | 3/2017 | Gaensbauer | B21B 37/32 |
| 2018/0281039 | A1 * | 10/2018 | Pralong | B21B 37/74 |

FOREIGN PATENT DOCUMENTS

| | | | | | |
|---|---|---|---|---|---|
| EP | 0290637 | A1 | * | 11/1988 | B21B 37/36 |
| FR | 2375920 | A1 | | 7/1978 | |
| GB | 2502156 | A | | 11/2013 | |
| JP | 2004306051 | A | * | 11/2004 | B21B 37/00 |
| KR | 20130014814 | A | * | 2/2013 | B21B 37/74 |
| WO | WO-8809229 | A1 | * | 12/1988 | B21B 37/32 |
| WO | 200000307 | A1 | | 1/2000 | |
| WO | 2017053343 | A1 | | 3/2017 | |

* cited by examiner

METHOD FOR PREHEATING A WORKING ROLL FOR ROLLING

CROSS-REFERENCE TO RELATED APPLICATIONS

This application is a National Stage entry of International Application No. PCT/FR2022/051290, filed 28 Jun. 2022, which claims priority to French Patent Application No. FR2107217, filed 2 Jul. 2021.

BACKGROUND

Field

The field of the invention is that of metallurgy and more specifically that of processes for rolling, preferably hot, metallic flat products produced in particular based on aluminum alloy.

Description of Related Art

In metallurgy, a rolling process performs forming by plastic deformation of a metal to produce in particular flat products (sheets, strips, bands, etc.), i.e., a product wherein the thickness is less than its width, which is also less than its length. The term metallic strip will be used here to refer to a flat product in general.

For this, a rolling mill usually includes one or more successive mill stands each formed from a pair of counter-rotating so-called work rolls of the same diameter. The metallic strip is deformed by compression by passing between the work rolls. To limit the deformation of the work rolls, the mill stand can include another pair of so-called back up rolls, each disposed in contact with the work roll.

However, the rolled metallic strip can have flatness defects, such as non-developable defects (e.g., edge waves, long middles, etc.) and developable defects (e.g., long bow, cross bow and twist defects, etc.). These defects can originate from deformation of the work rolls on account of the high intensity of the mechanical stress, as well as heterogeneous thermal expansion of the work rolls along their longitudinal axis.

To limit the appearance of these defects and obtain a rolled metallic strip which has the desired profile and flatness, different solutions can be implemented. For example, the back up rolls mentioned above can be used to reduce the deflection of the work rolls. Furthermore, the work rolls can have a grinding crown, or grinding profile, i.e., a variation of the diameter between the center of the cylinder and its ends, to seek a flatness of the metallic strip for example with slight edge waves or long middle, according to the mill stand in question. Moreover, the rolling mill can include a thermal control device adapted to cool or heat the work rolls locally to modify the thermal expansion profile (thermal profile).

To this end, the document WO00/00307A1 describes a process for hot rolling of a metallic strip in a mill including a thermal control device. In this example, the thermal control device makes it possible to modify the thermal expansion profile of the work rolls at the strip edge.

During rolling, the work rolls can expand on account of the heat produced in the roll gap, and have a concave-shaped thermal expansion profile: the diameter profile of each work roll then has an outward rounding (butt swell), which results in an increase in thickness of the metallic strip at its lateral edges. Note that, in this example, the work rolls have no grinding profile.

To limit this extra thickness at the strip edge, the thermal control device includes lateral induction coils disposed facing each work roll at the strip edge. Thus, the activation of the lateral induction coils makes it possible to modify the thermal expansion profile and more specifically the thermal expansion of the work rolls at the edge of the metallic strip, thus reducing the local extra thickness thereof.

The document FR2375920 describes another example of a mill including an induction coil thermal control device. In this example, the induction coils are evenly distributed along the longitudinal axis of the work rolls. The thermal control device also includes a downstream roll for measuring the distribution of tensile mechanical stress present in the rolled metallic strip, as well as a downstream sensor for measuring the distribution of thickness of the rolled metallic strip. A feedback loop is provided to adapt the thermal power supplied by each induction coil according to the measurement signals emitted by the downstream roll and the downstream sensor. However, this process results in a loss of material insofar as, on one hand, the thermal profile of the work rolls may not be stabilized during the rolling of the metallic strip, and, on the other, any defects are detected after passing the metallic strip in the roll gap.

In addition, it can be useful for preheating the work rolls before performing the rolling operation per se. This makes it possible in particular to avoid the use of so-called starting metallic strips, essentially intended to generate and stabilize the thermal expansion profile of the work rolls before the rolling operation, these starting metallic strips not generally being recycled and therefore potentially being scrapped.

To this end, the document WO2017/053343A1 describes a process for preheating work rolls. The thermal control device includes a nozzle for spraying a heating liquid (heating sprayers) and nozzles for spraying a cooling liquid (cooling sprayers), distributed along the longitudinal axis of the work rolls. The thermal control device furthermore includes multiple sensors to measure the surface temperature of the work rolls as well as the thermal expansion thereof. The values measured can be compared to those calculated by a predefined thermal model, to subsequently control the thermal power supplied by each of the heating and cooling sprayers. However, this process requires the use of multiple sensors, of which sensors for measuring the surface temperature of the work rolls.

SUMMARY OF THE INVENTION

The aim of the invention is that of remedying at least partially the drawbacks of the prior art, and more particularly that of providing a process for preheating at least one of the work rolls of a mill stand making it possible to expand the work roll according to a predefined target thermal expansion profile, quickly and efficiently, without needing to use different types of measurement sensors.

For this, the invention relates to a process for preheating at least one work roll of a rolling mill intended to roll a metallic strip so that the work roll has a target thermal expansion profile $$\left(\Delta d^{c}_{(i)}\right)_{1\leq i\leq Ns}$$

determined along Ns longitudinal segments of the work roll, the rolling mill including a thermal control device including Ni induction coils distributed along the longitudinal axis of the work roll facing the Ns longitudinal segments, the process including the following phases:

a/ determining the target thermal expansion profile $$(\Delta d^c_{(i)})_{1\le i\le Ns},$$

at a calculation time $t_k$, based on predefined values of input parameters Pe representative of the dimensions and mechanical and thermal properties of the metallic strip to be rolled, and a first predefined physical model M1 expressing a relationship between the input parameters Pe and the target thermal expansion profile $$(\Delta d^c_{(i)})_{1\le i\le Ns};$$

b/ determining an effective mean temperature profile $$(\overline{T}^{eff}_{(i)}(t_k))_{1\le i\le Ns}$$

along Ns longitudinal segments of the work roll, based on an effective thermal power profile $$(P^{eff}_{Q(i)}(t_{k-1}))_{1\le i\le Ni}$$

generated by the Ni induction coils and measured beforehand, and a second predefined physical model M2 expressing a relationship between the effective thermal power profile $$(P^{eff}_{Q(i)}(t_{k-1}))_{1\le i\le Ni}$$

and the effective mean temperature profile $$(\overline{T}^{eff}_{(i)}(t_k))_{1\le i\le Ns};$$

c/ determining a target mean temperature profile $$(\overline{T}^{c}_{(i)}(t_k))_{1\le i\le Ns}$$

along the Ns longitudinal segments of the work roll, based on the target thermal expansion profile $$(\Delta d^c_{(i)})_{1\le i\le Ns}$$

determined and the effective mean temperature profile $$(\overline{T}^{eff}_{(i)}(t_k))_{1\le i\le Ns}$$

determined;

d/ determining a deviation $\Delta\overline{T}(t_k)$ between the target mean temperature profile $$(\overline{T}^{c}_{(i)}(t_k))_{1\le i\le Ns}$$

and the effective mean temperature profile $$(\overline{T}^{eff}_{(i)}(t_k))_{1\le i\le Ns};$$

e/ determining a convergence criterion based on the deviation $\Delta\overline{T}(t_k)$ determined, and stopping the preheating when the convergence criterion is satisfied, and continuing the phases of the preheating process when the convergence criterion is not satisfied;

f/ activating the induction coils including the following steps: determining a target thermal power profile $$(P^{c}_{Q(i)}(t_k))_{1\le i\le Ni}$$

to be supplied by the Ni induction coils based on the deviation $\Delta\overline{T}(t_k)$ determined; activating the induction coils such that they supply the target thermal power profile $$(P^{c}_{Q(i)}(t_k))_{1\le i\le Ni}$$

determined; measuring an effective thermal power profile $$(P^{eff}_{Q(i)}(t_k))_{1\le i\le Ni}$$

supplied effectively by the induction coils;

repeating steps b/ to f/ until the convergence criterion is satisfied, by incrementing the calculation time $t_k$.

Some preferred but non-limiting aspects of this preheating process are as follows.

The target thermal expansion $$(\Delta d^c_{(i)})_{1\le i\le Ns},$$

effective mean temperature $$(\overline{T}^{eff}_{(i)}(t_k))_{1\le i\le Ns},$$

and target mean temperature $$\left(\overline{T}^{c}_{(i)}(t_k)\right)_{1\le i\le Ns}$$

profiles can be determined for the longitudinal segments intended to be in contact with the metallic strip to be rolled.

The step of determining the target thermal power profile $$\left(P^{c}_{Q(i)}(t_k)\right)_{1\le i\le Ni}$$

can include the following steps: identifying the longitudinal segment, of index jmax, for which the deviation $\Delta\overline{T}_{(jmax)}(t_k)$ is maximum, and definition of the target thermal power $$P^{c}_{Q(jmax)}(t_k)$$

at a maximum value; determining the target thermal power of the other longitudinal segments such that $$P^{c}_{Q(j)}(t_k) = P^{c}_{Q(jmax)}(t_k)\times\left(\Delta\overline{T}_{(j)}(t_k)\big/\Delta\overline{T}_{(jmax)}(t_k)\right).$$

An induction coil of index j can only be activated when the ratio $\Delta\overline{T}_{(j)}(t_k)/\Delta\overline{T}_{(jmax)}(t_k)$ is greater than or equal to a predefined threshold value $R_T$, otherwise it remains inactive.

The thermal control device can include coolers distributed along the longitudinal axis of the work roll facing the Ns longitudinal segments. The process can include a step of activating the coolers based on the deviation $\Delta\overline{T}(t_k)$ between the target mean temperature profile $$\left(\overline{T}^{c}_{(i)}(t_k)\right)_{1\le i\le Ns}$$

and the effective mean temperature profile $$\left(\overline{T}^{eff}_{(i)}(t_k)\right)_{1\le i\le Ns}.$$

The phase of determining the effective mean temperature profile $$\left(\overline{T}^{eff}_{(i)}(t_k)\right)_{1\le i\le Ns}$$

can be performed by digital simulation, the work roll being discretized according to a 2D axisymmetric mesh.

The metallic strip can be made of an aluminum alloy.

The invention further relates to a rolling process including the successive steps a) preheating at least one work roll, preferably two work rolls, of a rolling mill intended to roll a metallic strip according to the process according to the invention,
b) rolling the metallic strip with the thus preheated at least one work roll, preferably the two work rolls.

BRIEF DESCRIPTION OF THE DRAWINGS

Further aspects, aims, advantages and features of the invention will become more apparent on reading the following detailed description of preferred embodiments thereof, given by way of non-limiting example, with reference to the appended drawings wherein.

DETAILED DESCRIPTION OF A PREFERRED EMBODIMENT

In the figures and hereinafter in the description, the same references represent identical or similar elements. Furthermore, the different elements are not represented to scale so as to favor the clarity of the figures. Moreover, the different embodiments and alternative embodiments are not mutually exclusive and can be combined with each other. Unless specified otherwise, the terms "substantially", "approximately", "of the order of" mean within 10%, and preferably within 5%. Moreover, the terms "between . . . and . . . " and equivalents mean that the bounds are included, unless stated otherwise.

The invention relates to a process for preheating at least one work roll of a mill stand, making it possible to thermally expand the work roll locally, according to a predetermined target profile, before the metallic strip to be rolled is introduced into the roll gap. Hereinafter in the description, the metallic strip is produced based on aluminum, without the invention however being limited to this type of material.

The target thermal expansion profile of the preheating accounts for the features of the metallic strip to be rolled, and corresponds substantially to that generated during the rolling operation per se, by adding heat essentially obtained from the deformation of the metallic strip in the roll gap. In addition, following the preheating operation, the work roll then has a thermal stability similar or substantially identical to that during the rolling operation.

The target thermal expansion profile is predefined such that, during the rolling operation, the rolled metallic strip has, at the exit of the roll gap, the desired thickness profile and flatness. To this end, the flatness of a rolled metallic strip is defined based on an index IP corresponding to the ratio of the elongation of a material fiber relative to the mean length L of the fibers, such that: $IP=\Delta L/L\times10^5$.

Hereinafter in the description, the profile of a physical quantity associated with the work roll is the variation (or the distribution) of this physical quantity along the longitudinal axis of the roll. On the other hand, the profile of the metallic strip is the variation (or the distribution) of thickness in a cross-section along a transversal axis (widthwise) of the metallic strip.

Figure 1A:
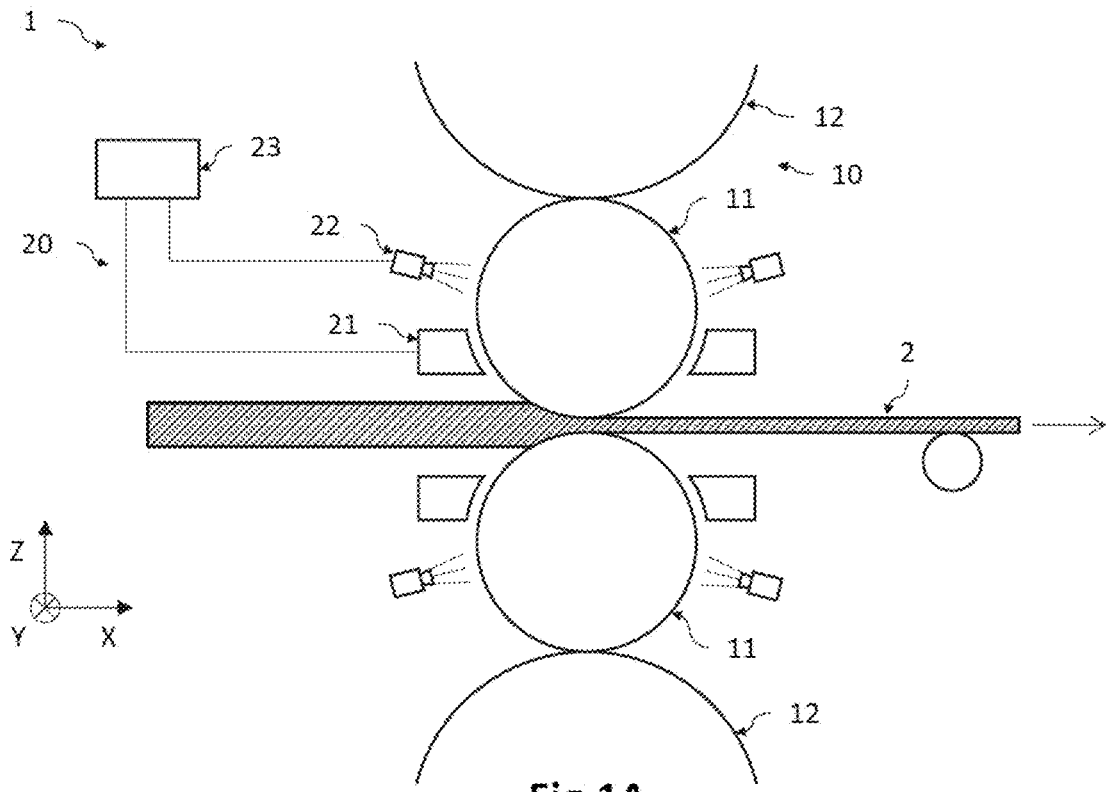
FIG. 1A is a schematic and partial view of a mill stand of a mill according to an embodiment, in a cross-section along the longitudinal axis of the rolling mill, illustrating the thermal control device.
Figure 1B:
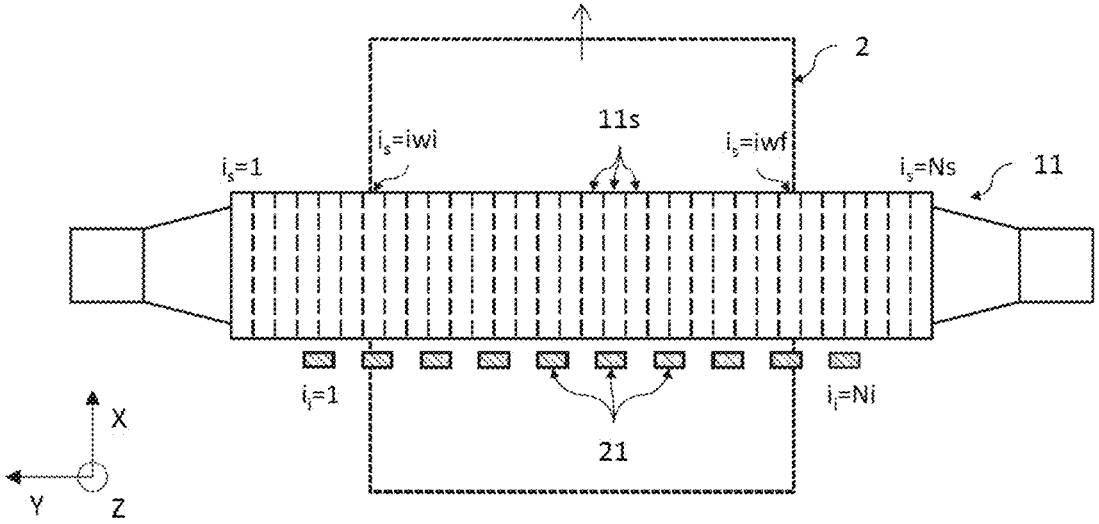
FIG. 1B is a schematic and partial view of a work roll of the mill stand of FIG. 1A, in a cross-section along the longitudinal axis of the work roll, illustrating the segmentation of the work roll into Ns longitudinal segments and the longitudinal distribution of the Ni induction coils.

FIG. 1A is a schematic and partial view of a rolling mill 1 including several successive mill stands 10, in a cross-section along the longitudinal axis of the rolling mill. Here only one mill stand 10 is shown. FIG. 1B is a schematic and partial view of the mill stand 10, in a cross-section along the longitudinal axis of the work roll.

Here and for the rest of the description, an orthogonal three-dimensional direct reference XYZ is defined, where the axis X is oriented along the rolling direction and corresponds to the longitudinal axis of the rolling mill 1 and the metallic strip 2 during rolling, the axis Y corresponds to the longitudinal axis of the rolls, and the axis Z is oriented along the height of the mill stand 10. The terms 'upstream' and 'downstream' are defined with reference to the longitudinal axis of the rolling mill 1, i.e., here to the axis X.

In this example, the rolling mill 1 can include several successive mill stands 10 to roll a single metallic strip 2. It also includes a thermal control device 20 adapted to control the thermal expansion profile of at least one of the work rolls 11 by means of a plurality of induction coils 21 and optionally coolers 22.

Each mill stand 10 is here of 'quarto' type and includes here a pair of work rolls 11 (lower and upper rolls), and a pair of back up rolls 12 (lower and upper). Obviously, other configurations are possible, such as 'sexto' or 'Sendzimir' type stands, inter alia. Each work roll 11 of the mill stands 10 can be equipped with induction coils 21 and optionally coolers 22 of the thermal control device 20. The rolling mill 1 can however include, upstream from the mill stands 10, at least one reversible stand not equipped with induction coils of the thermal control device.

The work rolls 11 are equipped here with induction coils 21 and coolers 22. They each have a diameter $d_{ref}$ at ambient temperature, outside operation, which is here constant along the longitudinal axis Y: $d_{ref}(y)=d_0$. This diameter can, alternatively, not be constant and can have a grinding profile: $d_{ref}(y)=d_0+\Delta d_{rec}(y)$ mentioned above.

The thermal control device 20 includes a plurality of induction coils 21 and optionally a plurality of coolers 22, connected to a processing unit 23. It makes it possible to generate, within the scope of the preheating of the work roll 11 in question, and therefore before the rolling operation, a thermal expansion profile at the work roll 11 in question which is substantially equal to a predetermined target profile.

For this, the work roll 11 is considered to be discretized along its entire length, along the longitudinal axis Y, into Ns successive longitudinal segments 11*s*, preferably of the same dimension. For example the work roll 11 can be discretized into several longitudinal segments 11*s* of width equal to approximately 20 mm along the axis Y.

The thermal control device 20 includes Ni induction coils 21, where here Ni≤Ns. They are distributed along the longitudinal axis Y facing the Ns successive longitudinal segments, at a rate here of 1 induction coil for several successive longitudinal segments 11*s*. Not all the longitudinal segments 11*s* necessarily include induction coils 21, in particular the longitudinal segments 11*s* located at the edge of the work roll 11 and which are not intended to form the roll gap (no contact with the metallic strip 2). The induction coils 21 can be placed upstream and/or downstream from the work roll 11. In this example, Ni induction coils are located upstream and Ni induction coils are located downstream from the work roll 11.

The induction coils 21 are adapted to transmit a thermal energy in the longitudinal segments 11*s* of the work roll 11. It consists here of electromagnetic induction heating, in that each induction coil 21 generates a magnetic field which induces an alternating electric current in the longitudinal segment(s) 11*s* facing which it is disposed. The electromagnetic power received by the longitudinal segments 11*s* is converted by Joule effect into heat power, which thus results in an increase in the mean temperature of the longitudinal segments 11*s* in question.

The induction coils 21 are activated and supply a thermal power in response to a control signal from the control unit 23 which defines a target value of the thermal power. However, it appears that the induction coils 21 may not supply the target value of the thermal power effectively. In addition, they each include a sensor (not shown) adapted to supply the processing unit 23 with a measurement of the thermal power actually supplied.

The thermal control device 10 can also include coolers 22, distributed along the work roll 11. Each cooler 22 can be a nozzle for spraying a cooling liquid. These coolers 22 thus make it possible to reduce the mean temperature of the longitudinal segments 11*s* of the work roll. They can be more or less numerous than the induction coils 21. Furthermore, the longitudinal arrangement of the coolers 22 may not coincide with that of the induction coils 21.

The processing unit 23 is adapted to perform calculations at different successive calculation times $t_k$, and to control the induction coils 21 and where applicable the coolers 22 such that the effective mean temperature profile of the longitudinal segments 11*s* (and therefore the effective thermal expansion profile) is substantially equal to the target mean temperature profile (and therefore to a target thermal expansion profile).

The processing unit 23 includes a programmable processor capable of executing instructions recorded in a data recording medium. It furthermore includes a memory containing the instructions required for the implementation of the preheating process. It is also adapted to store the data calculated at each calculation time $t_k$. It implements moreover two predefined physical models M1 and M2.

The first predefined physical model M1 expresses a relationship between, on one hand, input parameters Pe representative of dimensions and the mechanical and thermal properties of the metallic strip 2 to be rolled, and, on the other, a target thermal expansion profile of the work roll defined at the Ns longitudinal segments 11*s*.

The predefined physical model M1 can be a database (scales) obtained beforehand for example experimentally and/or digitally. Thus, to obtain the desired properties of the metallic strip 2 (thickness profiles, flatness, etc.) at the exit of the roll gap, the predefined physical model M1 establishes a relationship between the target thermal expansion profile required to obtain these properties of the metallic strip 2, and the input parameters Pe.

The input parameters Pe relate in particular to the mechanical features of the metallic strip 2 to be rolled such as the type of aluminum alloy, the thermal features such as the temperature of the metallic strip 2 at the entry of the mill stand 10 and the desired coiling temperature, the dimensions of the metallic strip 2 to be rolled such as its width W, the initial thickness H and the output thickness h. Further features can be taken into account. These input parameters Pe make it possible to estimate the rolling force and therefore the heat produced in the roll gap when rolling the metallic strip 2, as well the deflection of the work rolls under the mechanical force, these thermal and mechanical expansions being intended to be compensated by the preheating process according to the invention.

The target thermal expansion profile corresponds to the distribution along the longitudinal axis Y of the local variation $\Delta d_{th}(y)$ in diameter of the work roll 11 on account of a temperature variation ΔT between two successive calculation times $t_k$. It therefore consists of a variation in diameter relative to the reference profile $d_{ref}(y)$, whether the latter includes the grinding component $\Delta d_{rec}(y)$ or not. The target thermal expansion profile is independent of the calculation time $t_k$, and is determined at the start of the preheating process (it can however be adjusted according to the thermal state of the preceding mills (e.g., roughing stand). It is noted $$\Delta d_{th}^{c}(y)$$

when the profile is defined along the continuous y-axis y along the longitudinal axis Y, and is noted $$\left(\Delta d_{th(i)}^{c}\right)_{1\le i\le Ns}$$

or more simply $$\Delta d_{th}^{c}$$

(vector of Ns values) when it is defined along the Ns longitudinal segments 11*s*.

Figure 2A:
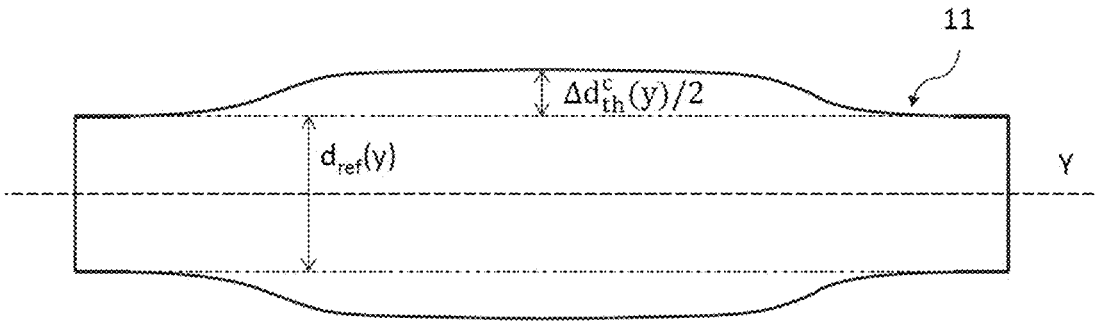
FIG. 2A is a schematic and partial view of a work roll, in a cross-section along its longitudinal axis, showing an example of a thermal expansion profile.

To this end, FIG. 2A illustrates a schematic and partial view, in a cross-section along the longitudinal axis Y, of a work roll 11 having a thermal expansion profile $\Delta d_{th}(y)$. The thermal expansion profile $$\Delta d_{th}^{c}(y)$$

corresponds to the deviation with the reference profile $d_{ref}(y)$. In this example, the reference profile $d_{ref}(y)$ is constant (no grinding component). Obviously, the thermal expansion profile $$\Delta d_{th}^{c}(y)$$

is not to scale to favor the clarity of the figure.

Figure 2B:
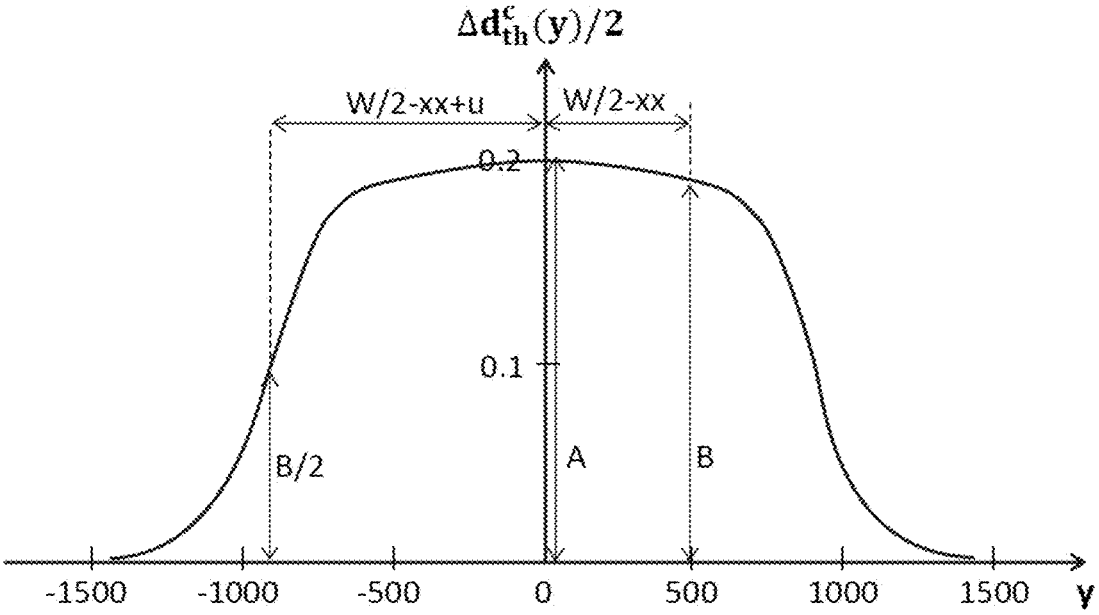
FIG. 2B illustrates an example of a target thermal expansion profile of the work roll, as well as the parameters A, B, xx and u for characterizing it.

FIG. 2B illustrates an example of a target thermal expansion profile $\Delta d_{th}(y)$ of a work roll 11 determined by the predefined physical model M1, showing the parameters for characterizing such a profile, the values of these parameters being stored in the predefined physical model M1. These parameters are noted here A, B, u and xx. In this example, A is equal to 0.2 mm, B is equal to 0.18 mm, xx to 500 mm, u to 400 mm, for a set of predefined input parameters Pe, of which a width W of the metallic strip 2 to be rolled equal to 2000 mm.

The target thermal expansion profile $\Delta d_{th}(y)$ is here a parabola over a distance W/2-xx from the center of the work roll 11 along the longitudinal axis Y (more specifically from the center of the table of the roll 11), with an amplitude A at the center, and an amplitude B at the y-axis xx. Then, between the position xx and the end of the table of the roll, the profile has a decline given by a function erf. The parameter u makes it possible to calculate the y-axis W/2-xx+u from the center of the table of the roll for which the profile equals B/2. Obviously, these parameters are given by way of illustration and other parameters can be used to characterize the target thermal expansion profile.

The predefined physical model M1 therefore includes the values of the parameters A, B, xx and u, which are dependent on the input parameters Pe. These values can furthermore correspond to a standardized profile for a reference ratio W to H (width of the metallic strip 2 over the input thickness H), for example here for W=1800 mm and H=18 mm. This standardization for a reference ratio W/H being useful when the input thickness is dependent in particular on the limits of the mill stand. These values can be given for the mill stand 10 in question, in particular for the first mill stand 10 as well as for the subsequent mill stands 10 (by means for example of a homothetic adaptation). Indeed, the preheating process can consist of heating the different mill stands 10 of the rolling mill before the rolling operation per se.

Moreover, when the rolling mill 1 includes a reversible stand upstream from the mill stands 10, the predefined physical model M1 can in particular provide an update of the values of the parameters A, B, xx and u according to the amplitude of the thermal expansion profile of the work rolls 11 of the reversible stand. Thus, for example, the value of this amplitude is known and is subtracted from the value of the parameter A. The reversible stand is an upstream stand which is not thermally controlled by the thermal control device 20, in that it does not include induction coils 21. On the other hand, it includes here coolers 22.

Finally, as stated hereinafter, when the target thermal expansion profile has been determined, the processing unit 23 performs its discretization along the Ns longitudinal segments 11*s*.

The predefined physical model M2 expresses, for each calculation time $t_k$, a relationship between a measured effective thermal power profile $$\left(P_{Q(i)}^{eff}(t_k)\right)_{1\le i\le N}$$

and an effective mean temperature profile $$\left(T_{(i)}^{eff}(t_k)\right)_{1\le i\le N}$$

of the work roll 11. Thereafter, the following vector notation is used for these profiles:

$$P_{Q}^{eff}(t_k)$$

and $\overline{T}^{eff}(t_k)$, where the vectors respectively include Ni and Ns values.

The effective thermal power profile $$P_{Q}^{eff}(t_k)$$

corresponds to the measurements made by the sensors of the Ni induction coils 21 at the calculation time $t_k$ and sent to the processing unit 23. Based on these measurements, the predefined physical model M2 determines the mean thermal energy received by the longitudinal segments 11*s* in question between the two consecutive calculation times. The predefined physical model M2 can be a database (scales) obtained beforehand for example experimentally and/or digitally.

The effective mean temperature profile $\overline{T}^{eff}(t_k)$ corresponds to the mean temperature of the Ns longitudinal segments 11*s* at the calculation time $t_k$, and is dependent in particular on the mean thermal energy received from the induction coils 21 (and where applicable the mean thermal energy lost on account of the coolers 22), and therefore the measured effective thermal power profile $$P_Q^{eff}(t_k).$$

It consists of a mean temperature of the longitudinal segments 11*s* of the work roll 11, and not only the mean temperature of the surface of the roll 11 in the longitudinal segments 11*s*. The mean temperature is therefore constant at all points of the volume of each longitudinal segment 11*s* in question.

The effective mean temperature profile $\overline{T}^{eff}(t_k)$ is here determined by means of digital simulation software by resolution of the predefined physical model M2 where the work roll 11 is discretized into an axisymmetric mesh, where the meshes are formed along the longitudinal axis Y of the Ns longitudinal segments 11*s*. It can consist of a 1D axisymmetric mesh where each mesh corresponds to a longitudinal segment, or a 2D axisymmetric mesh, i.e., along the longitudinal axis Y (longitudinal segments) and along a radial axis. The predefined physical model M2 is a physical model which assesses the incoming and outgoing thermal flows, and accounts for the thermal diffusion along the longitudinal axis Y. Thus, according to the mean thermal energy received by each longitudinal segment 11*s* (induction coils 21) and the mean thermal energy lost (coolers), the input parameters which make it possible to estimate a mechanical force and therefore a thermal energy produced in the roll gap during the rolling operation, the predefined physical model M2 (e.g., 2D axisymmetric model) is solved by digital simulation, for example in finite differences, and makes it possible to determine the effective mean temperature profile $\overline{T}^{eff}(t_k)$ of the Ns longitudinal segments.

Figure 3:
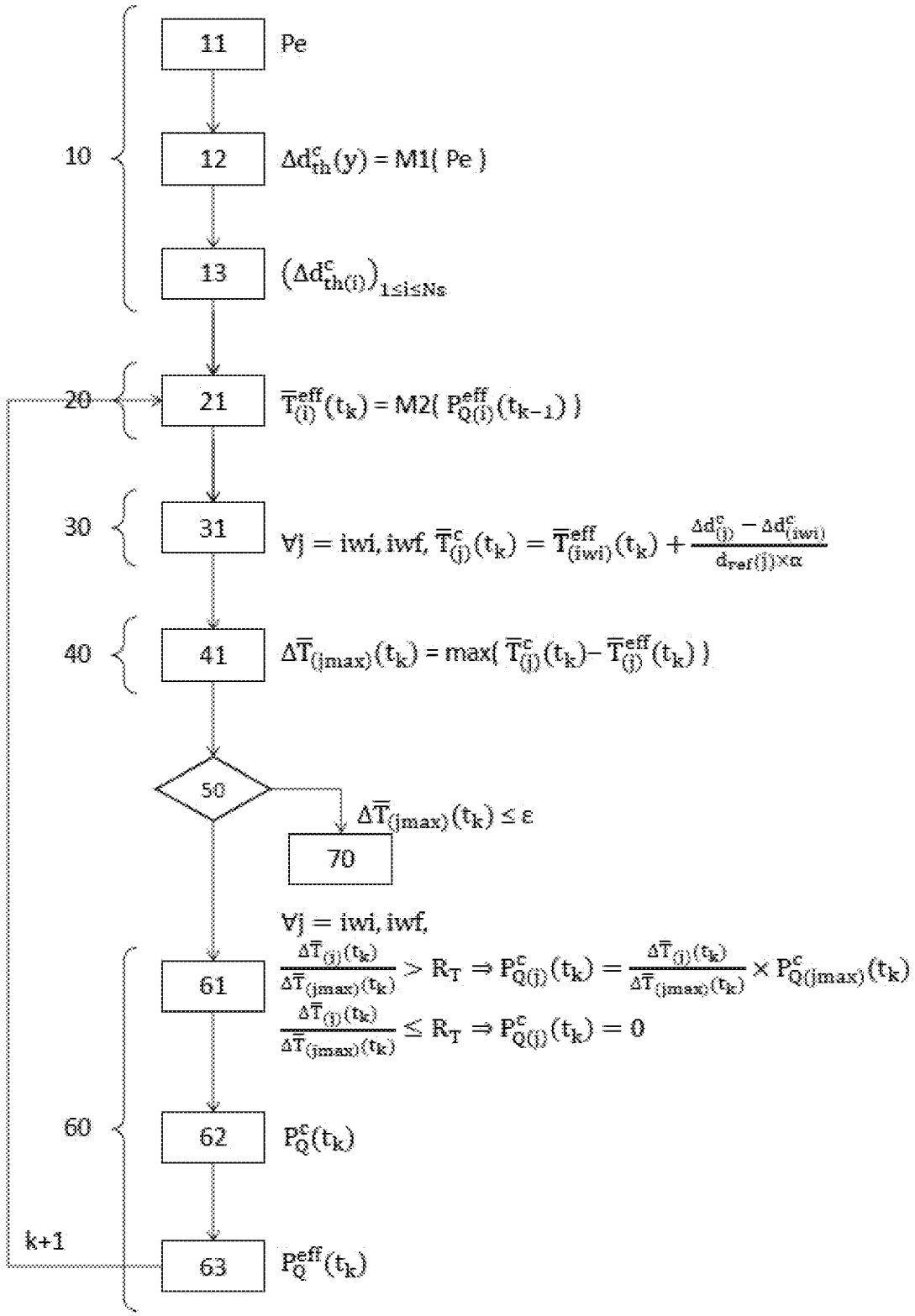
FIG. 3 is a flow chart of a preheating process implemented by the rolling mill in FIG. 1A according to an embodiment.

FIG. 3 illustrates a flow chart of a preheating process of a work roll 11 of a rolling mill 1 according to an embodiment. Obviously, the process can relate to the two work rolls 11 of the mill stand in question, as well as all of the mill stands of the rolling mill 1. The process is implemented before the rolling operation per se of the metallic strip 2, and stops when the rolling operation starts. The preheating can however be activated once again when the convergence criterion mentioned below is no longer satisfied.

As a general rule, the preheating process includes a preliminary phase 10 of determining the target thermal expansion profile $\Delta d^c$ of the work roll, subsequently followed by several phases performed at each calculation time $t_k$, namely a phase 20 of determining the effective mean temperature profile $\overline{T}^{eff}(t_k)$ of the work roll, a phase 30 of determining the target mean temperature profile $\overline{T}^c(t_k)$ of the work roll, then, based on a deviation between the two mean temperature profiles $\overline{T}^{eff}(t_k)$ and $\overline{T}^c(t_k)$ determined, a phase of activating or not the induction coils based on a target thermal power profile $$P_Q^{eff}(t_k)$$

that has been determined.

As stated above, the work roll 11 is discretized into Ns longitudinal segments 11*s*, and the thermal control device 20 includes Ni induction coils 21 distributed along the longitudinal axis Y, where here Ns≥Ni. In this example, for clarity purposes, the coolers 22 that may be included in the thermal control device 20 are disregarded.

Phase 10: determining a target thermal expansion profile $$\left(\Delta d_{th(i)}^c\right)_{1\le i\le Ns}$$

of the work roll 11. The vector notation $$\Delta d_{th}^c$$

is used hereinafter.

During a step 11, input parameters Pe representative of the mechanical features of the metallic strip 2 to be rolled such as the type of aluminum alloy, the thermal features such as the temperature of the metallic strip at the entry of the mill stand and the desired coiling temperature, the dimensions of the metallic strip 2 to be rolled such as its width W, the initial thickness H and the output thickness h are defined.

During a step 12, the processing unit 23 then determines the target thermal expansion profile $$\Delta d_{th}^c$$

based on the input parameters Pe defined and by means of the predefined physical model M1 implemented in the memory of the processing unit 23.

During a step 13, the target thermal expansion profile $$\Delta d_{th}^c(y)$$

is discretized on the Ns longitudinal segments 11*s*, to thus obtain the profile $$\left(\Delta d_{th(i)}^c\right)_{1\le i\le Ns}(\text{noted } \Delta d_{th}^c).$$

Note that the thermal expansion profile $$\Delta d_{th}^c,$$

as well as the target $\overline{T}^c(t_k)$ and effective $\overline{T}^{eff}(t_k)$ mean temperature profile may only be defined for the longitudinal segments 11*s* intended to be contact with the metallic strip 2, i.e., here for the longitudinal segments 11*s* of index ranging from iwi to iwf.

The subsequent phases 20 to 60 are performed iteratively at different successive times, the time being discretized at a predefined calculation frequency, for example every 45 seconds. Thus, a calculation time $t_k$ also referred to as current time is associated with each iteration of rank k.

Phase 20: determining an effective mean temperature profile $$\left(\overline{T}^{eff}_{(i)}(t_k)\right)_{1\le i\le Ns}$$

(noted $\overline{T}^{eff}(t_k)$) of the Ns longitudinal segments 11*s* of the work roll 11.

During a step 21, the effective mean temperature profile $\overline{T}^{eff}(t_k)$ of the work roll 11 is determined. As stated above, it consists of the mean temperature of each longitudinal segment 11*s* of the work roll 11 (constant temperature on the surface and in the volume of the longitudinal segment), and not only the surface temperature. This mean temperature is responsible for the (mean) thermal expansion of the longitudinal segment 11*s* in question.

This profile is determined using an effective thermal power profile $$\left(P^{eff}_{Q(i)}(t_{k-1})\right)_{1\le i\le Ni}$$

(and noted vectorially $$P^{eff}_{Q}(t_k))$$

supplied by the induction coils 21 and measured beforehand by the sensors of the induction coils 21 at the calculation time $t_{k+1}$, and by means of the second predefined physical model M2 expressing a relationship between the effective thermal power profile $$P^{eff}_{Q}(t_k)$$

and the effective mean temperature profile $\overline{T}^{eff}(t)$. During the first calculation time $t_{k=1}$, the induction coils 21 having not yet supplied the thermal power, the effective temperature profile $\overline{T}^{eff}(t_{k=1})$ can be equal to ambient temperature, or can be equal to a predefined temperature (uniform or not) corresponding to the thermal state of the work rolls following prior rolling operations for example.

Phase 30: determining a target mean temperature profile $$\left(\overline{T}^{c}_{(i)}(t_k)\right)_{1\le i\le Ns}$$

(noted $\overline{T}^{c}(t_k)$) of the Ns longitudinal segments 11*s* of the work roll 11.

During a step 31, the target mean temperature profile $\overline{T}^{c}(t_k)$ of the Ns longitudinal segments 11*s* of the work roll 11 is defined, based on the effective mean temperature profile $\overline{T}^{eff}(t_k)$ and the target thermal expansion profile $$\Delta d^{c}_{th}.$$

For this, a longitudinal segment 11, here of index iwi, where one of the lateral edges of the metallic strip 2 is located, is taken as a reference. Then, the target mean temperature is calculated based on the following equation:

$$\forall_j = iwi, iwf\ \overline{T}^{c}_{(j)}(t_k) = \overline{T}^{eff}_{(iwi)}(t_k) + \left(\Delta d^{c}_{(j)} - \Delta d^{c}_{(iwi)}\right)/(\alpha\times d_{ref}(j)),$$

where $d_{ref}(j)$ is the reference diameter at the index j, and where a is the mean thermal expansion coefficient of the work roll 11. Obviously, other calculations, are possible.

Phase 40: determining a deviation $\Delta\overline{T}(t_k)$ between the target mean temperature profile $\overline{T}^{c}(t_k)$ and the effective mean temperature profile $\overline{T}^{eff}(t_k)$.

During a step 41, a maximum deviation $\Delta\overline{T}_{(jmax)}(t_k)$ is determined here between the target mean temperature profile $\overline{T}^{c}(t_k)$ and the effective mean temperature profile $\overline{T}^{eff}(t_k)$. For this, the longitudinal segment 11*s* of index jmax located between iwi and iwf for which the temperature deviation is maximum:

$$\Delta\overline{T}_{(jmax)}(t_k) = \max_{j=iwi,iwf}\left(\overline{T}^{c}_{(j)}(t_k) - \overline{T}^{eff}_{(j)}(t_k)\right).$$

The aim is here that of identifying the induction coil 21 closest to this longitudinal segment of index jmax of which the target thermal power will be brought to a maximum value.

Phase 50: convergence criterion

During a step 50, a convergence criterion is determined wherein a comparison is made to a predefined threshold value E of a deviation $Ec(t_k)$ representative of the deviation $\Delta\overline{T}(t_k)$ between the target mean temperature profile $\overline{T}^{c}(t_k)$ and the effective mean temperature profile $\overline{T}^{eff}(t_k)$. This deviation $Ec(t_k)$ is therefore also representative of the deviation between the target thermal expansion profile $\Delta d^{c}(t_k)$ and the effective thermal expansion profile $\Delta d^{eff}(t_k)$.

The deviation $Ec(t_k)$ can be defined in different ways. It can consist of the local maximum value $\Delta\overline{T}_{(jmax)}(t_k)$ between the target mean temperature profile $\overline{T}^{c}(t_k)$ and the effective mean temperature profile $\overline{T}^{eff}(t_k)$. It can also consist of a point-by-point comparison between the target mean temperature profile $\overline{T}^{c}(t_k)$ and the effective mean temperature profile $\overline{T}^{eff}(t_k)$, for example a mean or a sum, optionally weighted, of the difference in absolute value between these two profiles. It can also consist of an activation time of the induction coil 21 associated with the longitudinal segment of index jmax, i.e., that for which the temperature deviation $\Delta\overline{T}_{(jmax)}(t_k)$ is maximum.

The convergence criterion is considered as satisfied when the deviation $Ec(t_k)$ is less than or equal to the threshold value E, in which case the preheating of the work roll(s) is considered as completed (step 70). An item of information can then be given to the user of the rolling mill 1, for example the deviation $Ec(t_k)$ in question, or an item of remaining heating time information (ratio between the temperature deviation and the injected thermal power). However, the convergence criterion is considered as not satisfied when the deviation $Ec(t_k)$ is greater than the threshold value E, in which case the preheating process continues with phase 60. Note that phase 50 is performed here between phases 40 and 60, but it can obviously be performed at other times of the process, for example after phase 60. In the case where the convergence criterion is not satisfied, the process continues with phase 60.

Phase 60: determining a target thermal power profile $$\left(P^{c}_{Q(i)}(t_k)\right)_{1\le i\le Ni}(\text{noted } P^{c}_{Q}(t_k))$$

and activating the induction coils accordingly.

During a step 61, the target thermal power profile $$P^{c}_{Q}(t_k)$$

to be supplied by the induction coils 21 is determined. It is possible to this end to envisage only activating the induction coils 21 intended to be facing the metallic strip during the rolling operation, i.e., located facing the longitudinal segments 11*s* of indexes between iwi and iwf. For this, the target thermal power of the induction coil 21 of index jmax is defined at 100% of the maximum thermal power $P_{Q,max}$. The target thermal power $$P^{eff}_{Q(j)}(t_k)$$

to be supplied by the other induction coils 21 of index j is then defined as being equal to the maximum thermal power $P_{Q,max}$ modulated by the ratio $\Delta\overline{T}_{(j)}(t_k)\Delta\overline{T}_{(jmax)}(t_k)$. To account for the lateral thermal diffusion, an activation threshold can be taken into account: thus, when the ratio $\Delta\overline{T}_{(jmax)}(t_k)/\Delta\overline{T}_{(jmax)}(t_k)$ is less than a predefined threshold $R_T$, the induction coil 21 of index j in question is not activated. The target thermal power profile $$P^{c}_{Q}(t_k)$$

of the induction coils 21 is thus obtained.

During a step 62, a control signal is sent by the processing unit 23 to the induction coils 21 so that they supply a target thermal power $$P^{c}_{Q}(t_k).$$

According to the value of the target thermal power $$P^{c}_{Q(j)}(t_k),$$

the induction coils 21 are activated or not and supply (or attempt to supply) the determined target thermal power. In an equivalent way, the control signal can be sent to the coolers 22 when the local effective mean temperature is greater than the local target mean temperature, so as to reduce the corresponding deviation.

During a step 63, each sensor of the induction coils 21 measures the thermal power $$P^{eff}_{Q(j)}(t_k)$$

actually supplied, here simultaneously with their operation, and sends the measured value thereof to the processing unit 23. These values thus form an effective thermal power profile $$P^{eff}_{Q}(t_k).$$

When the convergence criterion has not been satisfied, phases 20 to 50 are then repeated, and the calculation time $t_k$ is incremented.

On the other hand, if it has been satisfied, this phase 60 may not have been performed, and the information is given to the operator of the rolling mill 1 that the effective mean temperature profile $\overline{T}^{eff}(t_k)$ has converged toward the target mean temperature profile $\overline{T}^{c}(t_k)$, and therefore the effective thermal expansion profile $$\Delta d^{eff}_{th}(t_k)$$

has converged toward the target thermal expansion profile $$\Delta d^{c}_{th}(t_k).$$

The rolling operation of the metallic strip 2 can therefore start and the induction coils 21 can be deactivated, immediately (or not), insofar as the heat produced by rolling the metallic strip 2 in the roll gap will trigger a thermal expansion of the work roll 21 corresponding to the target thermal expansion profile $$\Delta d^{c}_{th}.$$

It appears that the preheating process according to the invention makes it possible to preheat simply and effectively the work roll(s) 11 before the implementation of the rolling of the metallic strip 2 per se. Indeed, the use of induction coils 21 and a predefined physical model M2 receiving the measurements of the effective thermal power of the induction coils 21 make it possible to modify quickly and precisely the effective mean temperature profile so that it tends toward the target mean temperature profile.

Indeed, the induction coils 21 modify the mean surface and volume temperature of the longitudinal segments 11*s*, and not only the surface temperature such as the nozzles for spraying a heating liquid, which makes it possible to use a simplified predefined physical model M2, for example a 2D axisymmetric type model, which directly determines the mean temperature of the longitudinal segments of the work roll without involving the measurement of the surface temperature. On the other hand, in the prior art where nozzles for spraying a heating liquid are provided, the physical model requires more complexity and must determine the mean temperature based on the measurement of the surface temperature (hence the use of specific sensors). Furthermore, the injected thermal power is sent directly into the longitudinal segments of the work roll, with no exchange coefficient, since there is overheating by Joule effect of the eddy currents induced. On the other hand, with a heating liquid (e.g., water), the energy efficiency is impacted by the exchange coefficient, and the maximum overheating is limited by the boiling point of the liquid.

Particular embodiments have just been described. Various variants and modifications are possible within the scope of the invention. Thus, as mentioned above, the thermal control device can include coolers distributed along the longitudinal axis Y of the work roll, and the processing unit can send a control signal to the coolers based on the deviation $\Delta T(t_k)$ between the target mean temperature profile $T^c(t_k)$ and the effective mean temperature profile $T^{eff}(t_k)$.

In a preferred embodiment, the metallic strip comprises an aluminum alloy, preferably the aluminum alloy is an alloy chosen, according to the aluminum association designation, from AA2014, AA2017, AA2024, AA2027, AA2046, AA2050, AA2056, AA2060, AA2074, AA2098, AA2139, AA2195, AA2198, AA2214, AA2219, AA2519, AA2524, AA2618, AA2654, AA3003, AA3004, AA3005, AA3103, AA3104, AA3105, AA5005, AA5049, AA5050, AA5052, AA5083, AA5086, AA5088, AA5150, AA5154, AA5182, AA5186, AA5200, AA5251, AA5252, AA5254, AA5383, AA5454, AA5456, AA5657, AA5754, AA6016, AA6056, AA6060, AA6061, AA6063, AA6082, AA6156, AA6182, AA6909, AA7010, AA7011, AA7017, AA7019, AA7020, AA7021, AA7022, AA7039, AA7040, AA7049, AA7050, AA7056, AA7072, AA7075, AA7079, AA7099, AA7122, AA7150, AA7175, AA7178, AA7449, AA7450 or AA7475 alloy.

In an embodiment, the metallic strip is a cladded aluminum alloy. In an embodiment, the aluminum alloy is cladded on at least one side, preferably two sides with a 1000 Series alloy according to the Aluminum Association, preferably AA1050 alloy or with AA7072 alloy. In a preferred embodiment, the central part of the cladded aluminum is AA2024 alloy or AA2524 alloy and the cladding is a 1000 Series alloy, preferably AA1050. In another preferred embodiment, the central part of the cladded aluminum is AA7075, AA7175 or AA7475 alloy and the cladding is AA7072 alloy. Cladded aluminum alloys are known as cladded product in the standard NF EN 12258-1.

In a preferred embodiment, the rolling of the metallic strip is a hot rolling. Preferably, the hot rolling is carried out with a rolling mill which is part of a plurality of hot mills operating in tandem, preferably preceded by a hot reversing mill.

In an embodiment, the temperature of the aluminum alloy, optionally cladded, prior to its hot rolling is at least 350° C. and at most 510° C. or 490° C. or 470° C. or 450° C. or 430° C. or 410° C. or 390° C. or 370° C. In another embodiment, the temperature of the aluminum alloy, optionally cladded, prior to its hot rolling is at least 370° C. and at most 510° C. or 490° C. or 470° C. or 450° C. or 430° C. or 410° C. or 390° C. In another embodiment, the temperature of the aluminum alloy, optionally cladded, prior to its hot rolling is at least 390° C. and at most 510° C. or 490° C. or 470° C. or 450° C. or 430° C. or 410° C. In another embodiment, the temperature of the aluminum alloy, optionally cladded, prior to its hot rolling is at least 410° C. and at most 510° C. or 490° C. or 470° C. or 450° C. or 430° C. In another embodiment, the temperature of the aluminum alloy, optionally cladded, prior to its hot rolling is at least 430° C. and at most 510° C. or 490° C. or 470° C. or 450° C. In another embodiment, the temperature of the aluminum alloy, optionally cladded, prior to its hot rolling is at least 450° C. and at most 510° C. or 490° C. or 470° C. In another embodiment, the temperature of the aluminum alloy, optionally cladded, prior to its hot rolling is at least 470° C. and at most 510° C. or 490° C. In another embodiment, the temperature of the aluminum alloy, optionally cladded, prior to its hot rolling is at least 490° C. and at most 510° C.

In an embodiment, the temperature of the aluminum alloy, optionally cladded, after its hot rolling is at least 230° C. and at most 370° C. or 350° C. or 330° C. or 310° C. or 290° C. or 270° C. or 250° C. In another embodiment, the temperature of the aluminum alloy, optionally cladded, after its hot rolling is at least 250° C. and at most 370° C. or 350° C. or 330° C. or 310° C. or 290° C. or 270° C. In another embodiment, the temperature of the aluminum alloy, optionally cladded, after its hot rolling is at least 270° C. and at most 370° C. or 350° C. or 330° C. or 310° C. or 290° C. In another embodiment, the temperature of the aluminum alloy, optionally cladded, after its hot rolling is at least 290° C. and at most 370° C. or 350° C. or 330° C. or 310° C. In another embodiment, the temperature of the aluminum alloy, optionally cladded, after its hot rolling is at least 310° C. and at most 370° C. or 350° C. or 330° C. In another embodiment, the temperature of the aluminum alloy, optionally cladded, after its hot rolling is at least 330° C. and at most 370° C. or 350° C. In another embodiment, the temperature of the aluminum alloy, optionally cladded, after its hot rolling is at least 350° C. and at most 370° C.

In an embodiment, the surface temperature of the preheated work roll is at least 200° C. and at most 320° C. or 300° C. or 280° C. or 260° C. or 240° C. or 220° C. In another embodiment, the surface roll temperature during hot rolling is at least 220° C. and at most 320° C. or 300° C. or 280° C. or 260° C. or 240° C. In another embodiment, the surface roll temperature during hot rolling is at least 240° C. and at most 320° C. or 300° C. or 280° C. or 260° C. In another embodiment, the surface roll temperature during hot rolling is at least 260° C. and at most 320° C. or 300° C. or 280° C. In another embodiment, the surface roll temperature during hot rolling is at least 280° C. and at most 320° C. or 300° C. In another embodiment, the surface roll temperature during hot rolling is at least 300° C. and at most 320° C.

In another preferred embodiment, the rolling of the metallic strip is a cold rolling. Preferably, the cold rolling is carried out with a rolling mill which is part of a plurality of cold mills operating in tandem.

In an embodiment, the surface temperature of the preheated work roll is at least 100° C. and at most 200° C. or 180° C. or 160° C. or 140° C. or 120° C. In another embodiment, the surface roll temperature during cold rolling is at least 120° C. and at most 200° C. or 180° C. or 160° C. or 140° C. In another embodiment, the surface roll temperature during cold rolling is at least 140° C. and at most 200° C. or 180° C. or 160° C. In another embodiment, the surface roll temperature during cold rolling is at least 160° C. and at most 200° C. or 180° C. In another embodiment, the surface roll temperature during cold rolling is at least 180° C. and at most 200° C.

For example, the two work rolls, of diameter 700 mm, of a hot mill were each equipped with 33 induction coils of 80 mm along the length of said rolls. The work rolls were discretized into 20 mm long segments for the implementation of the preheating process according to the invention. The use of the process for preheating the rolls made it possible to do away with the use of starting metallic strips to stabilize the thermal profiles required to hot roll aluminum alloys. This improvement relates in particular to AA5083, AA5086, AA5088, AA5182, AA5052, AA5754, AA2098, AA2198, AA2195, AA2024 and AA2524 alloys. This improvement also relates to cladded aluminum alloys, the central part being an AA2024 or AA2524 aluminum alloy and the cladding being AA1050. This improvement also relates to cladded aluminum alloys, of which the central part is an AA7075 or AA7175 aluminum alloy and of which the cladding is AA7072.

The invention claimed is:

1. A process for preheating at least one work roll of a rolling mill intended to roll a metallic strip so that the at least one work roll has a target thermal expansion profile $$\left(\Delta d^{c}_{(i)}\right)_{1\le i\le Ns}$$

determined along longitudinal segments Ns of the at least one work roll, the rolling mill including a thermal control device including induction coils Ni distributed along a longitudinal axis of the at least one work roll facing the longitudinal segments Ns, the process comprising the following phases:

a. determining the target thermal expansion profile $$\left(\Delta d^{c}_{(i)}\right)_{1\le i\le Ns},$$

at a calculation time $t_k$, based on predefined values of input parameters Pe representative of dimensions and mechanical and thermal properties of the metallic strip to be rolled, and using a first predefined physical model M1 to express a relationship between the input parameters Pe and the target thermal expansion profile $$\left(\Delta d^{c}_{(i)}\right)_{1\le i\le Ns};$$

b. determining an effective mean temperature profile $$\left(\overline{T}^{eff}_{(i)}(t_k)\right)_{1\le i\le Ns}$$

along longitudinal segments Ns of the at least one work roll, based on a measured effective thermal power profile $$\left(P^{eff}_{Q(i)}(t_{k-1})\right)_{1\le i\le Ni}$$

generated by the induction coils Ni, and using a second predefined physical model M2 to express a relationship between the effective thermal power profile $$\left(P^{eff}_{Q(i)}(t_k)\right)_{1\le i\le Ni}$$

and the effective mean temperature profile $$\left(\overline{T}^{eff}_{(i)}(t_k)\right)_{1\le i\le Ns};$$

c. determining a target mean temperature profile $$\left(\overline{T}^{c}_{(i)}(t_k)\right)_{1\le i\le Ns}$$

along the longitudinal segments Ns of the at least one work roll, based on the target thermal expansion profile $$\left(\Delta d^{c}_{(i)}(t_k)\right)_{1\le i\le Ns}$$

determined and the effective mean temperature profile $$\left(\overline{T}^{eff}_{(i)}(t_k)\right)_{1\le i\le Ns}$$

determined;

d. determining a deviation $\Delta\overline{T}(t_k)$ between the target mean temperature profile $$\left(\overline{T}^{c}_{(i)}(t_k)\right)_{1\le i\le Ns}$$

and the effective mean temperature profile $$\left(\overline{T}^{eff}_{(i)}(t_k)\right)_{1\le i\le Ns};$$

e. determining a convergence criterion based on the deviation $\Delta\overline{T}(t_k)$ determined, and stopping the preheating process when the convergence criterion is satisfied, and continuing the preheating process when the convergence criterion is not satisfied;

f. activation of the induction coils including the following:

determining a target thermal power profile $$\left(P^{c}_{Q(i)}(t_k)\right)_{1\le i\le Ni}$$

to be supplied by the induction coils Ni based on the deviation $\Delta\hat{T}(t_k)$ determined;

activating the induction coils such that the induction coils supply the target thermal power profile $$\left(P^{c}_{Q(i)}(t_k)\right)_{1\le i\le Ni}$$

determined;

measuring an effective thermal power profile $$\left(P^{eff}_{Q(i)}(t_k)\right)_{1\le i\le Ni}$$

actually supplied by the induction coils;

g. repeating b to f until the convergence criterion is satisfied, by incrementing the calculation time $t_k$.

2. The preheating process according to claim 1, wherein the target thermal expansion $$\left(\Delta d^{c}_{(i)}\right)_{1\le i\le Ns},$$

the effective mean temperature $$\left(\overline{T}^{eff}_{(i)}(t_k)\right)_{1\le i\le Ns},$$

and the target mean temperature $$\left(\overline{T}^{c}_{(i)}(t_k)\right)_{1\le i\le Ns}$$

profiles are determined for each of the longitudinal segments Ns intended to be in contact with the metallic strip to be rolled.

3. The preheating process according to claim 1, wherein the determining the target thermal power profile $$\left(P^{c}_{Q(i)}(t_k)\right)_{1\le i\le Ni}$$

includes the following:

identifying one of the longitudinal segments Ns, of index jmax, for which the deviation $\Delta T_{(jmax)}(t_k)$ is maximum, and defining a target thermal power $$P^{c}_{Q(jmax)}(t_k)$$

at a maximum value;

determining a target thermal power of others of the longitudinal segments Ns such that $$P^{c}_{Q(j)}(t_k) = P^{c}_{Q(jmax)}(t_k)\times\left(\Delta\overline{T}_{j}(t_k)/\Delta\overline{T}_{(jmax)}(t_k)\right).$$

4. The preheating process according to claim 3, wherein one of the induction coils Ni, of index j is only activated when a ratio $\Delta\overline{T}_{(j)}(t_k)/\Delta\overline{T}_{(jmax)}(t_k)$ is greater than or equal to a predefined threshold value $R_T$, otherwise the one of the induction coils Ni remains inactive.

5. The preheating process according to claim 1, wherein the thermal control device includes coolers distributed along the longitudinal axis of the at least one work roll facing the longitudinal segments Ns, and including activating the coolers based on the deviation $\Delta\overline{T}(t_k)$ between the target mean temperature profile $$\left(\overline{T}^{c}_{(i)}(t_k)\right)_{1\le i\le Ns}$$

and the effective mean temperature profile $$\left(\overline{T}^{eff}_{(i)}(t_k)\right)_{1\le i\le Ns}.$$

6. The preheating process according to claim 1, wherein the phase of determining the effective mean temperature profile $$\left(\overline{T}^{eff}_{(i)}(t_k)\right)_{1\le i\le Ns}$$

is performed by digital simulation, the at least one work roll being discretized according to a 2D axisymmetric mesh.

7. The preheating process according to claim 1, wherein the metallic strip is produced from an aluminum alloy.

8. A rolling process comprising the following:

a. preheating at least one work roll of a rolling mill using the preheating process according to claim 1, b. using the at least one preheated work roll to roll the metallic strip.

9. The rolling process according to claim 8, wherein the metallic strip comprises an aluminum alloy.

10. The rolling process according to claim 9, wherein the aluminum alloy is cladded on at least one side with a 1000 Series alloy according to the Aluminum Association.

11. The rolling process according to claim 8, wherein the rolling of the metallic strip is a hot rolling.

12. The rolling process according to claim 11 wherein the temperature of the metallic strip prior to hot rolling thereof is at least 350° C. and at most 510° C.

13. The rolling process according to claim 11, wherein a surface temperature of the at least one preheated work roll is at least 200° C. and at most 320° C.

14. The rolling process according to claim 8, wherein the rolling of the metallic strip is a cold rolling.

15. The rolling process according to claim 14, wherein a surface temperature of the at least one preheated work roll is at least 100° C. and at most 200° C.

16. The rolling process according to claim 9, wherein the aluminum alloy is an alloy chosen from AA2014, AA2017, AA2024, AA2027, AA2046, AA2050, AA2056, AA2060, AA2074, AA2098, AA2139, AA2195, AA2198, AA2214, AA2219, AA2519, AA2524, AA2618, AA2654, AA3003, AA3004, AA3005, AA3103, AA3104, AA3105, AA5005, AA5049, AA5050, AA5052, AA5083, AA5086, AA5088, AA5150, AA5154, AA5182, AA5186, AA5200, AA5251, AA5252, AA5254, AA5383, AA5454, AA5456, AA5657, AA5754, AA6016, AA6056, AA6060, AA6061, AA6063, AA6082, AA6156, AA6182, AA6909, AA7010, AA7011, AA7017, AA7019, AA7020, AA7021, AA7022, AA7039, AA7040, AA7049, AA7050, AA7056, AA7072, AA7075, AA7079, AA7099, AA7122, AA7150, AA7175, AA7178, AA7449, AA7450 or AA7475.

17. The rolling process according to claim 9, wherein the aluminum alloy is cladded on two sides with AA1050 alloy or with AA7072 alloy.

18. The rolling process according to claim 8, wherein the metallic strip is cladded.

* * * * *